US006552643B2

(12) United States Patent
Chen

(10) Patent No.: US 6,552,643 B2
(45) Date of Patent: Apr. 22, 2003

(54) STRUCTURE OF A DEPRESS-TYPE SAFETY SWITCH

(76) Inventor: Shang-Hao Chen, PO Box 82-144, Taipei (TW)

( * ) Notice: Subject to any disclaimer, the term of this patent is extended or adjusted under 35 U.S.C. 154(b) by 90 days.

(21) Appl. No.: 09/732,762

(22) Filed: Dec. 11, 2000

(65) Prior Publication Data

US 2002/0070839 A1 Jun. 13, 2002

(51) Int. Cl.[7] ..... H01H 71/58; H01H 71/16

(52) U.S. Cl. ..... 337/66; 337/37; 337/36; 337/68

(58) Field of Search ..... 337/333, 334, 337/345, 379, 66–69, 53, 59, 74–76, 36, 39, 37, 79, 85, 91, 112, 113, 140; 200/553–557

(56) References Cited

U.S. PATENT DOCUMENTS

| | | | | | |
|---|---|---|---|---|---|
| 3,792,403 | A | * | 2/1974 | Bullock | 337/66 |
| 4,447,686 | A | * | 5/1984 | Fieber et al. | 200/524 |
| 4,704,594 | A | * | 11/1987 | Krasser | 337/66 |
| 5,369,237 | A | * | 11/1994 | Mejerl et al. | 200/524 |
| 5,498,846 | A | * | 3/1996 | Chin | 200/553 |
| 5,786,742 | A | * | 7/1998 | Yin | 337/347 |
| 5,841,085 | A | * | 11/1998 | Rittinghaus et al. | 200/16 R |
| 6,094,126 | A | * | 7/2000 | Sorenson | 337/37 |
| 6,377,159 | B1 | * | 4/2002 | Yu | 337/37 |
| 6,392,180 | B1 | * | 5/2002 | Yu | 200/523 |
| 6,445,273 | B1 | * | 9/2002 | Yu | 337/37 |
| 6,456,185 | B1 | * | 9/2002 | Yu | 337/37 |
| 6,483,416 | B2 | * | 11/2002 | Yu | 337/126 |

FOREIGN PATENT DOCUMENTS

| | | | | |
|---|---|---|---|---|
| EP | 285340 | A2 | * 10/1988 | H01H/73/30 |

* cited by examiner

*Primary Examiner*—Anatoly Vortman
(74) *Attorney, Agent, or Firm*—Leong C. Lei

(57) ABSTRACT

An improved structure of a depress-type safety switch comprising a main body, press button, actuating block, the top section of the main body being opened to accommodate the press button and the actuating block, and the bottom panel being provided with a left, center and a right terminal for connection to a socket and a power source wire, the interior of the actuating block being provided with a main spring, characterized in that the right side of the actuating block is a top section with a positioning slot having a V-shaped engaging block, and the right terminal is connected upward to a bi-metallic engaging plate made from two metals of different properties, the top end of the engaging plate is a fastening peg extended to the positioning slot of the actuating block, thereby the depression of the press button allows the fastening of a fastening peg at the bi-metallic engaging plate with the engaging block to form a closed circuit, and if the current is overload or a short circuit is formed as a insult of high temperature, the heat is transferred from the right terminal to the bi-metallic engaging plate and is moved toward the right so that the fastening peg is disengaged from the fastener, and the press button is restored to its original position by the main spring to form an opened circuit.

1 Claim, 6 Drawing Sheets

STRUCTURE OF A DEPRESS-TYPE SAFETY SWITCH

BACKGROUND OF THE INVENTION (a) Field of the Invention

The present invention relates to an improved stricture of a depress-type safety switch, and in particular, a simple and easy-installed automatic safety switch being employed in the socket of an extension wire.

(b) Description of the Prior Art

Conventional safety switches are widely available in the market, and some of these switches have very complicated structure and are complicated in manufacturing and installation. Therefore, these increase the production cost. It is not economical if these switches are used in socket for the commonly available extension wire. There is a commonly found extension wire with a set of insertion holes associated with an individual switch. As a result, the cost of this extension wire is high and it is also not economically to be employed in the extension wire.

Accordingly, it is an object of the inventor to provide an improved structure of a depress-type safety switch, which can eliminate the above-mentioned drawbacks.

SUMMARY OF THE INVENTION

Accordingly, it is an object of the present invention to provide an improved structure of a depressive safety switch comprising a main body, press button, actuating block, wherein the top section of the main body is opened to accommodate the press button and the actuating block, and the bottom panel is provided with a left, a center and a right terminal for connection to a socket and a power source wire. The interior of the actuating block is provided with a main spring, and the safety switch is characterized in that the right side of the actuating block is a top section with a positioning slot having a V-shaped engaging block, and the right terminal is connected upward to a bi-metallic engaging plate made from two metals of different properties, and the top end of the engaging plate is a fastening peg extended to the positioning slot of the actuating block, thereby the depression of the press button allows the fastening of a fastening peg at the bi-metallic engaging plate with the engaging block to form a closed circuit, and if the current exceeds a predetermined value or a short circuit occurs, heat is transferred from the right terminal to the bi-metallic engaging plate and is moved toward the right so that the fastening peg is disengaged from the fastener, and the press button is restored to its original position by the main spring to form an opened circuit.

The foregoing object and summary provide only a brief introduction to the preset invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
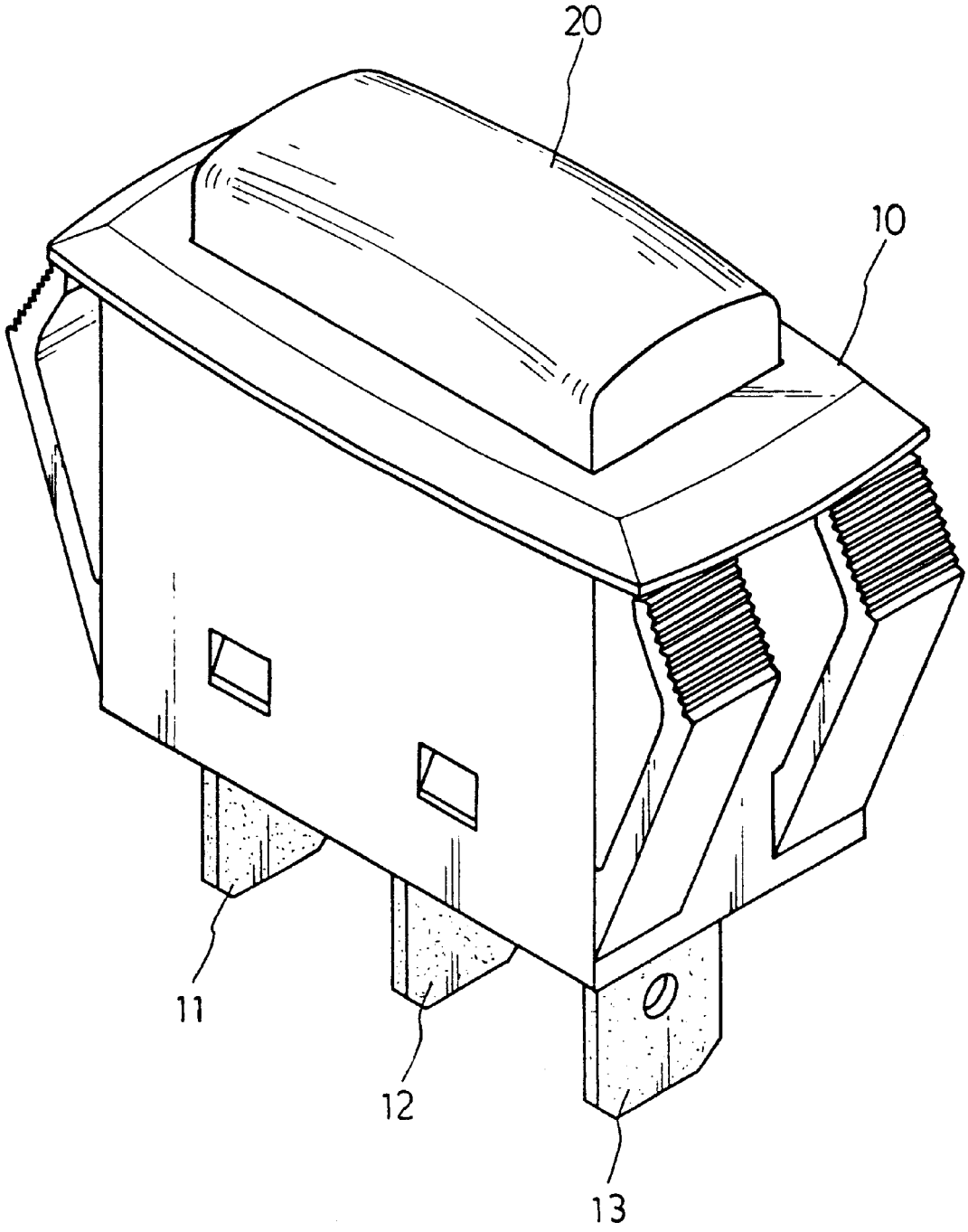
FIG. 1 is a perspective view of an improved structure of a depress-type safety switch of the present invention.
Figure 2:
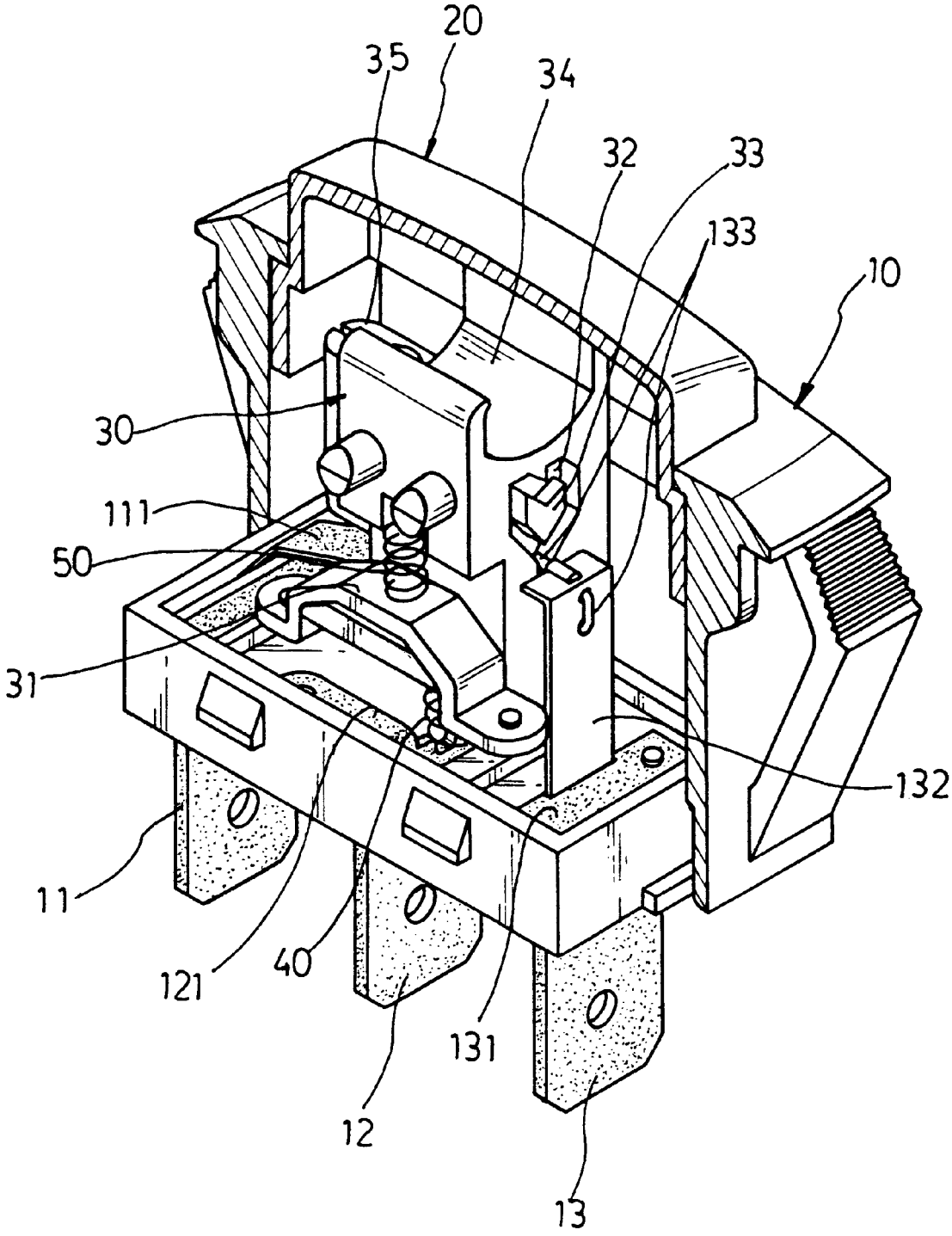
FIG. 2 is a partial-cut away view of the front section of an improved structure of a depress-type safety switch of the present invention.
Figure 3:
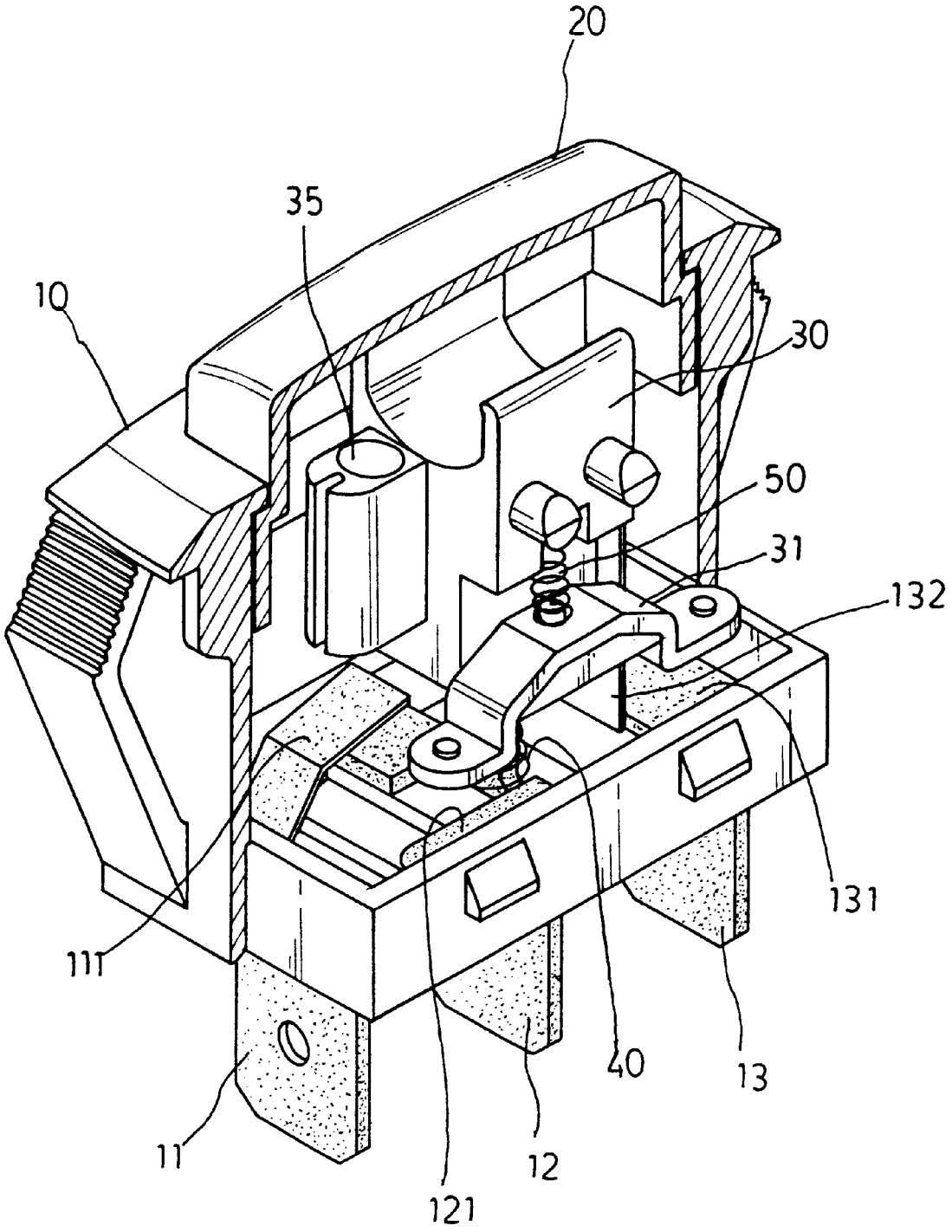
FIG. 3 is a partial-cut away view of an improved structure of a depress-type safety switch of the rear section of an improved structure of a depress-type safety switch of the present invention.

Referring to FIGS. 1, 2, 3, 4A and 4B, there is shown an improved structure of a depress-type safety switch comprising a main body 10, press button 20 and an actuating block 30. The top section of the main body 10 is open, and the bottom section of the main body 10 is provided with three holes respectively inserted with a left terminal 11, a center terminal 12, and a right terminal 13. The rear end of the left terminal 11 extended to the rear main body 10 is a slightly bent contact spring 111. One side of the rear end of the center terminal 12 is bent to form a conductively connected panel 121, and the rear end of the right terminal 13 is bent to form a conducting panel 131. On the conducting panel 131 is mounted a bi-metallic mounting plate 132. The end terminal of the mounting plate 132 is provided with a fastening peg 133, which is biased to the left. After the combination of the center of the bottom section of the press button 20 with the actuating block 30, it is positioned at the opening area of the main body 10. The interior of the actuating block 30 is formed with a spring hole and the top section thereof has a light bulb cavity slot 34 for the accommodation of a light bulb 60. The left side thereof is provided with a resistance cavity slot 35 for the mounting of a resistor 70. One connection leg of the light bulb 60 is extended to the spring hole, and the other connection leg of the light bulb 60 is connected to a connection leg of the resistor 70. The other leg of the resistor 70 faces the bottom side and corresponds to the contact spring plate 111 of the left terminal 11. The actuating block 30 is provided with a main spring 40 which is extended downward to urgingly press the center terminal 12. The other end urges the actuating block 30 and is in contact with the connection leg of the light bulb 60 such that the press button connected integrally with the actuating block 30 is provided with elasticity when it is depressed. The right side of the actuating block 30 is formed with a positioning slot 32, and within the slot, an engaging block 33 is provided and the positioning slot 32 is formed into circular ring-shaped slot, and the fastening peg 133 of the bi-metallic mounting plate 132 is extended into the circular ring-shaped slot. The front side of actuating block 30 is provided with a slot to accommodate a conducting seat 31 with a left and right contact plates, and the top face thereof is provided with a secondary spring 50, which elastically urges the actuating block 30. The above structure is installed at the socket of extension wire, and the power source wire of the socket passes to the center terminal and the right terminal and is connected to the socket.

Referring to FIGS. 4A, 4B, 5A, 5B, 6A, 6B, 7A and 7B, there is shown schematically the pressing action of the safety switch. As shown in the figures, the positioning slot 32 having a centrally located engaging block 33 is formed into slot surrounded by the engaging block 33. The slot has a left region 321 and a right region 322. The bottom end

Figure 4A:
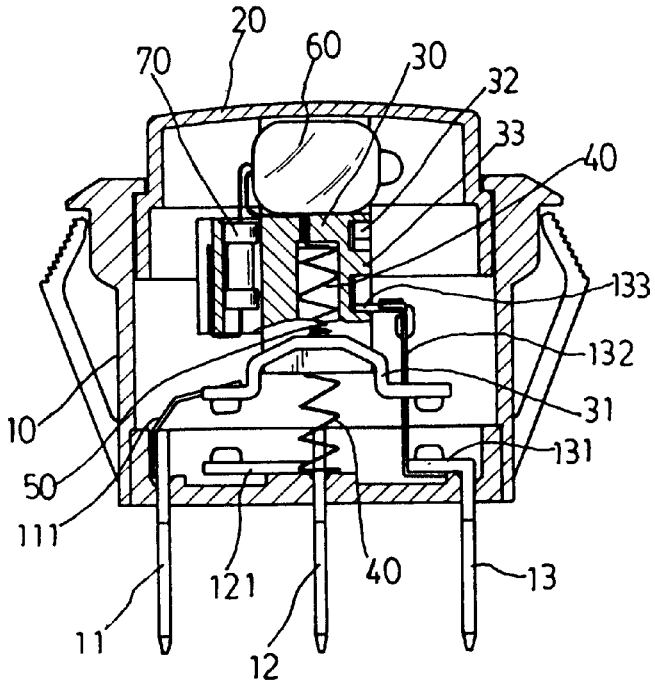
FIGS. 4A, 4B, 5A, 5B, 6A, 6B, 7A and 7B show schematic views of pressing action of the present invention.
Figure 4B:
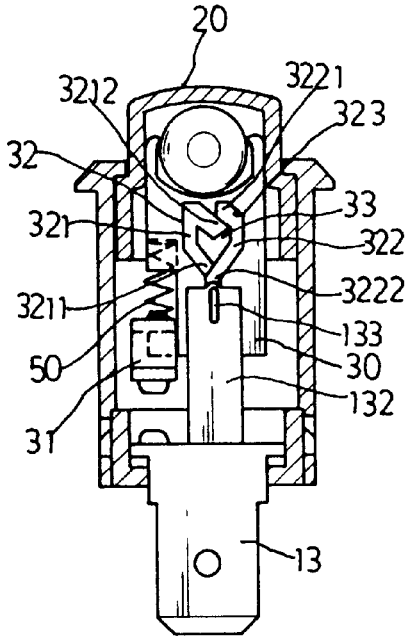
Figure 5A:
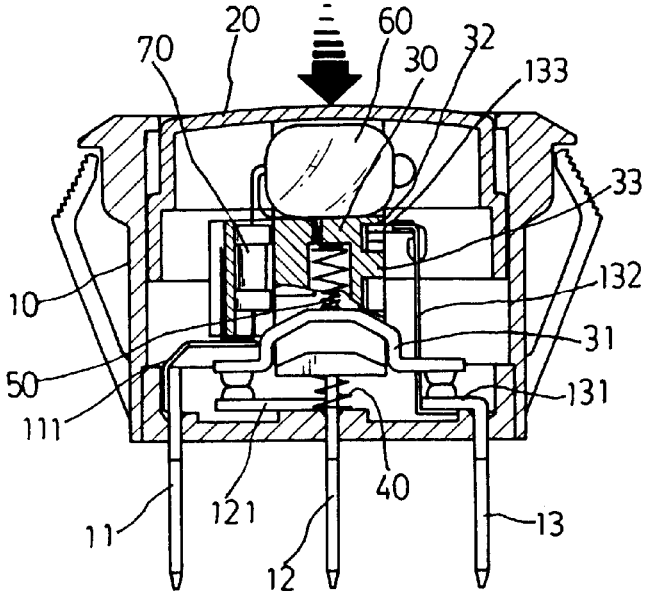
Figure 5B:
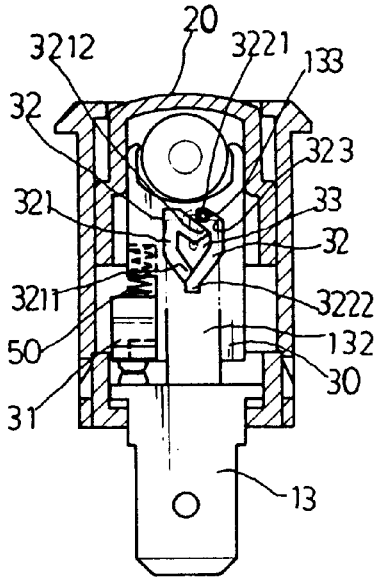

3211 of the left region 321 is comparatively higher and it becomes relatively lower when it goes upward. The top end 3212 is the lowest. The intersection region of the top end 3221 of the right region 322 and the top end 3212 is comparatively higher, and it becomes lower towards the bottom. The intersection at the bottom end 3222 and 3211 is the lowest (lower than the position 3211). FIGS. 4A and 4B show a press button 20, which has not been depressed. At this instance, the end terminal of the fastening peg 133 is located at the bottom end 3222 of the right region 322. FIGS. 5A and 5B show the press button 20 which is depressed externally. The actuating block 30 and the connection seat 31 of the front side thereof move downwardly, and the position 3222, which is the position of the fastening peg 133, is lower th the position 3211 of the left region. Thus, when the positioning slot 32 moves downwardly with the actuating block 30, the fastening peg 133 will move to the top end of the intersection of 3221 and 3212 of the right region 322 for contact. At this instance, the connection seat 31 simultaneously contacts the connection panel 121, 131 of the center terminal 12 and the right terminal 13, thereby forming a closed circuit.

Figure 6A:
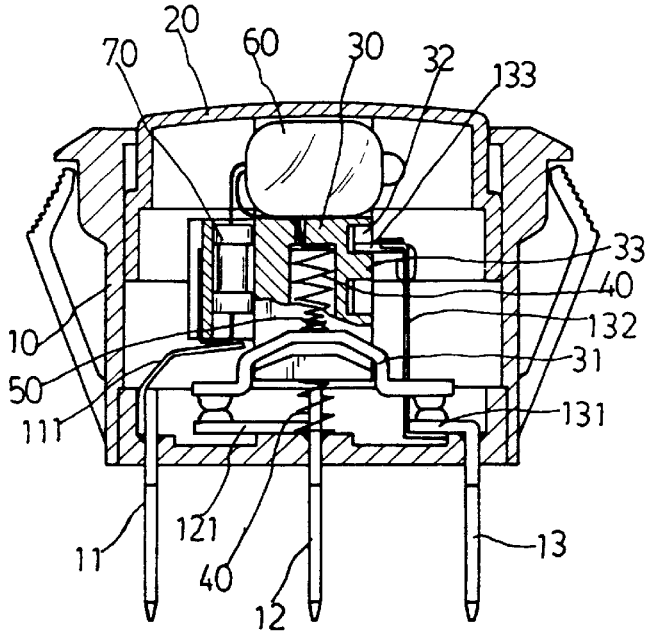
Figure 6B:
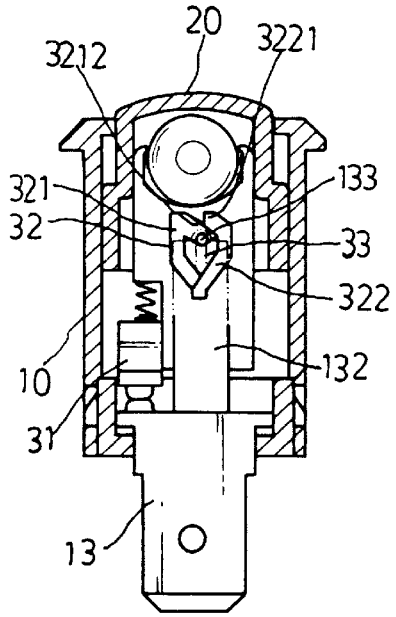
Figure 7A:
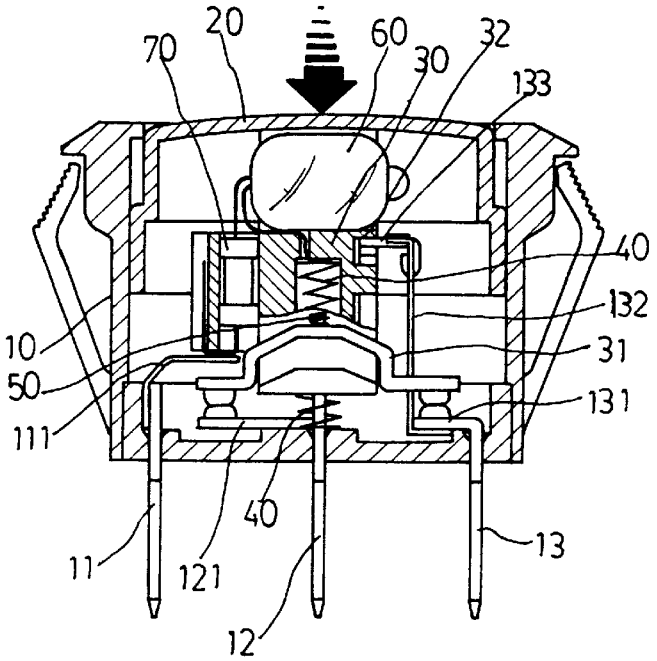
Figure 7B:
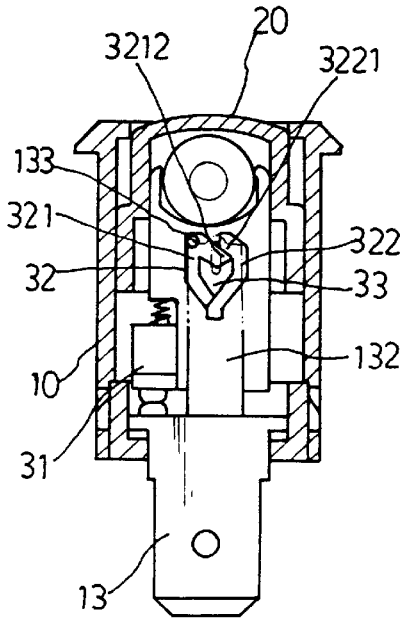

The connection leg at the bottom of the resistor 70 at the left side of the actuating block 30 is in contact with the contact spring plate 111 of the left terminal 11 such that the center terminal 12 is electrically communicated and the light bulb 60 is lighted. As shown in FIGS. 6A and 6B, the top end of the engaging block 33 is a V-shaped slot, and when the external force is released, the actuating block 30 is restored by the main spring 40, and the fastening peg 133 being blocked by the V-shaped slot is located at the position 3212 and engages the actuating block 30, and the center terminal 12 and the right terminal maintain electrically in communication, so as to electrically connect the circuit of the socket, and the bulb 60 is continuously lighted. As shown in FIGS. 7A and 7B, when the press button 20 is again depressed with an external force, the positioning slot 32 of the actuating block 30 moves downward. At this instance, the position 3212 at the right region of the fastening peg 133 is lower than the right region position 3221. Thus, the fastening peg 133 moves along the left region 321 when the external force is removed, and the main spring 40 causes the actuating block 30 to drive the press button 20 to restore upward (as shown in FIGS. 4A and 4B), such that the closed circuit is now opened and the power source of the socket is switched off.

Figure 8A:
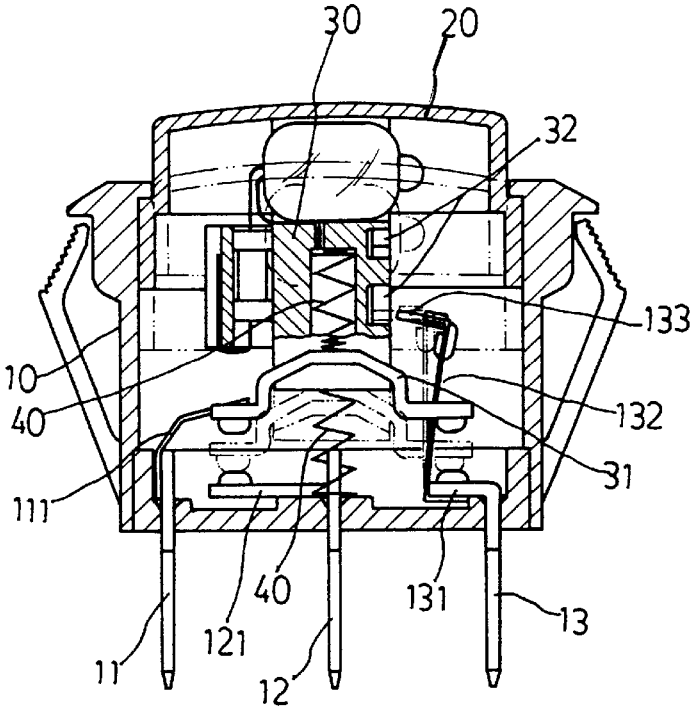
FIGS. 8A and 8B are schematic views of automatic current cut-off in accordance with the present invention.
Figure 8B:
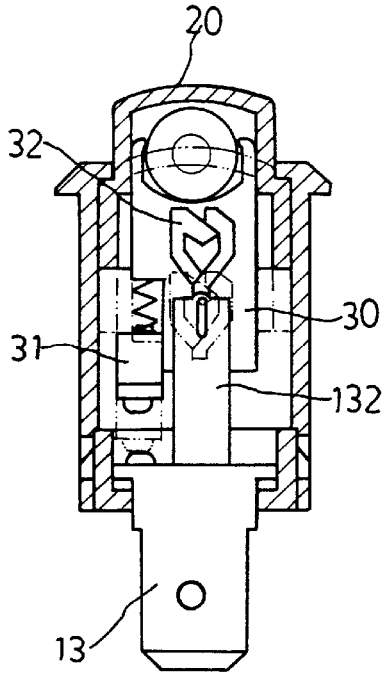

Referring to FIGS. 8A and 8B, when the press button 20 is located at the depress status and the socket is under overload, the temperature of the wire is abnormally high, and the temperature of the individual terminal becomes higher. If the temperature of the right terminal 113 is higher the permitted temperature, the excessive heat will be transferred to the engaging plate 132. By means of the bi-metallic engaging plate 132, the plate 132 will bend toward the right and the fastening peg 133 at the top end of the engaging plate 132 moves to the fastening slot 32, and the fastening of the engaging block 33 is released, such that the actuating block 30, under the action of the main spring, the press button 20 is driven to its original position and the circuit is opened so as to prevent electric shock, and the safety of the extension wire is greatly improved. After the temperature of the bi-metallic engaging plate 132 has become low, it will restore to its original position and the switch operates normally.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A structure of a depress-type safety switch comprising a main body, a press body, a press button, and an actuating block, wherein said main body has an open top in which are fitted the press button and the actuating block, said main body has a bottom provided with three holes respectively inserted a first terminal, a second terminal and a third terminal disposed between said first and second terminals, said actuating block is provided with a first spring bearing against said third terminal, said actuating block is formed with a positioning slot in which is mounted an engaging block, an upper end of said second terminal is bent to form a conducting panel on which is mounted a bi-metallic mounting plate having a fastening peg extended into said positioning slot, said actuating block is formed with a recess in which is fitted a second spring, said actuating block is formed with a slot in which is fitted a conducting seat with two contact plates, said second spring bearing against said conducting seat, whereby when said press button is depressed, said fastening peg of said bi-metallic mounting plate is engaged with said engaging block, and said two contact plates of said conducting seat are in contact with said third and second terminals thereby forming a closed circuit, and if current exceeds a predetermined value or a short-circuit occurs, heat is transferred from said second terminal to said bi-metallic mounting plate thereby releasing said fastening peg from said engaging block and therefore making said first spring to push said press button to original position to form an open circuit.

* * * * *